US008842863B2

(12) United States Patent
Nielsen et al.

(10) Patent No.: US 8,842,863 B2
(45) Date of Patent: Sep. 23, 2014

(54) TWO PART HEARING AID WITH DATABUS CONNECTION

(75) Inventors: Kim Hjortggard Nielsen, Frederikssund (DK); Soren Kilsgaard, Smorum (DK)

(73) Assignee: Widex A/S, Lynge (DK)

( * ) Notice: Subject to any disclaimer, the term of this patent is extended or adjusted under 35 U.S.C. 154(b) by 207 days.

(21) Appl. No.: 13/237,228

(22) Filed: Sep. 20, 2011

(65) Prior Publication Data

US 2012/0039497 A1 Feb. 16, 2012

Related U.S. Application Data

(63) Continuation-in-part of application No. PCT/EP2009/054075, filed on Apr. 6, 2009.

(51) Int. Cl.
*H04R 25/00* (2006.01)

(52) U.S. Cl.
USPC ..... 381/323; 381/322; 381/324

(58) Field of Classification Search
CPC ..... H04R 25/00
USPC ..... 381/312, 322–324, 326–328, 330
See application file for complete search history.

(56) References Cited

U.S. PATENT DOCUMENTS

| | | | | |
|---|---|---|---|---|
| 5,878,146 | A | 3/1999 | Andersen | |
| 2004/0095189 | A1 | 5/2004 | Rochow | |
| 2004/0116151 | A1 | 6/2004 | Bosch et al. | |
| 2006/0233398 | A1 | 10/2006 | Husung | |
| 2008/0107292 | A1 | 5/2008 | Kornagel | |
| 2009/0262964 | A1 * | 10/2009 | Havenith et al. | 381/314 |

FOREIGN PATENT DOCUMENTS

| | | | |
|---|---|---|---|
| CN | 101094541 | A | 12/2007 |
| DE | 102005013833 | B3 | 6/2006 |
| DE | 102005006404 | B3 | 8/2006 |
| EP | 0823829 | A2 | 2/1998 |
| EP | 1871141 | A2 | 12/2007 |
| JP | 10-126895 | A | 5/1998 |
| WO | 2007/004083 | A1 | 1/2007 |
| WO | 2008/010716 | A2 | 1/2008 |

OTHER PUBLICATIONS

Japanese OA for Japanese Patent Application No. 2012-503867 dated Dec. 11, 2012 with English translation.
International Search Report PCT/EP2009/054075 dated Dec. 8 2009.
Office Action for corresponding Chinese Application No. 200980158633.2 dated Nov. 19, 2013, with English Abstract.

* cited by examiner

*Primary Examiner* — Suhan Ni
(74) *Attorney, Agent, or Firm* — Sughrue Mion, PLLC

(57) ABSTRACT

A two part hearing aid includes a base part (1) to be arranged outside the ear canal of a hearing aid user, the base part including microphone (3, 4), signal processor (23) and a power supply (8). The hearing aid also includes an ear plug part (2) having acoustic transmitter (5, 10) for transmitting sound into the ear canal, an ear canal microphone (11), and an electronic module (7) connected to said ear canal microphone (11). The hearing aid further includes an elongated member (40) having electrical wires (15, 17, 42, 43) for connecting the ear plug part (2) with the base part (1), using a serial databus. The invention further provides a method for communicating between two parts of a hearing aid.

23 Claims, 4 Drawing Sheets

TWO PART HEARING AID WITH DATABUS CONNECTION

RELATED APPLICATIONS

The present application is a continuation-in-part of application No. PCT/EP2009054075, filed on Apr. 6, 2009, in Europe and published as WO2010/115451 A1.

BACKGROUND OF THE INVENTION

1. Field of the Invention

The present invention relates to hearing aids. The invention further relates to a method for communication between two parts of a hearing aid. The invention more specifically concerns a two part hearing aid comprising power supply means and at least one microphone for transforming an acoustic signal in the surroundings of a hearing aid user into an electric signal.

The hearing aid comprises a base part to be arranged outside the ear canal of a hearing aid user, said base part comprising signal processing means. The hearing aid also comprises an ear plug part to be arranged in the ear canal of a hearing aid user, said ear plug part comprising acoustic output means for transmitting sound into the ear canal, an ear canal microphone for transforming an acoustic signal in the ear canal into an electric signal, and an electronic module connected to said ear canal microphone. The hearing aid further comprises an elongated member connecting said ear plug part with said base part. The elongated member comprises electrical wires adapted for providing power supply from the base part to the ear plug part, or, from the ear plug part to the base part.

Hearing aids are often made as a two part device with one part, an ear plug, for being arranged in the ear canal of the hearing aid user, and another part, a base part, for being arranged outside the ear canal. Often the base part is arranged behind the ear, known as a behind-the-ear hearing aid. The base part will usually comprise signal processing means, one or two microphones and a battery. Often a receiver is also arranged in the base part. A sound tube will then connect the base part with the ear plug part, and sounds from the receiver will be transmitted through this sound tube to the ear plug part transmitting the sound further to the ear drum of the hearing aid user.

2. The Prior Art

In a known alternative the receiver is arranged in the ear plug part and connected with the signal processing means in the base part through e.g. two wires. In this case the sound tube is replaced by electric leads, suitably encapsulated.

It has been suggested to arrange a microphone in the ear plug, at the side proximally to the tympanic membrane, for transforming sounds in the ear canal into electrical signals. Such a microphone may have many purposes during fitting and during daily use of the hearing aid. The electrical signal from such a microphone needs to be transferred to the signal processing means of the base part of the hearing aid, normally by an extra pair of wires. It has now been realized that one problem in having such a microphone is that the wires used for transferring the signal from the microphone to the base part will gather electrical noise. The electrical signal generated in the microphone is relatively weak, e.g. 5-10 μV, and therefore rather sensitive to noise.

It has also now been realized that this problem is larger when a receiver is arranged in the ear plug, since the wires supplying the receiver signal, which may be 2 V at peak level, will be arranged close to the wires transferring the signal from the microphone. Therefore, it is likely that the receiver signal will induce noise into the wires carrying the microphone signal.

Another problem is that the number of wires preferably should be as low as possible in order to keep the diameter of the elongated member connecting the two parts as small as possible.

SUMMARY OF THE INVENTION

The invention, in a first aspect, provides a hearing aid comprising a power supply means at least one microphone for transforming an acoustic signal in the surroundings of a hearing aid user into an electric signal; a base part to be arranged outside the ear canal of a hearing aid user, said base part comprising signal processing means; an ear plug part to be arranged in the ear canal of a hearing aid user, said ear plug part comprising acoustic transmitting means for transmitting sound into the ear canal, an ear canal microphone for transforming an acoustic signal in the ear canal into an electric signal, and an electronic module connected to said ear canal microphone; and an elongated member connecting said ear plug part with said base part, said elongated member comprising electrical wires adapted for providing power supply from the base part to the ear plug part, or, from the ear plug part to the base part, wherein the signal from the ear canal microphone is transferred to the signal processing means in said base part by a one line bidirectional serial databus connected through a data line arranged in said elongated member.

A serial databus is here understood to be a digital communication line which can be set up for communication between different units, suitable for carrying signals in more than one direction.

In an embodiment according to the invention the base part is adapted to be arranged behind the ear.

In an embodiment according to the invention the base part comprises the at least one microphone for receiving sound signals from the surroundings. Alternatively, as disclosed in DE-B3-102005006404 and in DE-B3-102005013833, a microphone for receiving sound signals from the surroundings may also be arranged in the ear plug part.

In an embodiment according to the invention the base part will preferably also comprise either or both of the signal processing means and a battery for power supply.

In an embodiment according to the invention the elongated member comprises three electrical wires, where two would typically be for power supply, and one for the data line. In further embodiments the elongated member comprises more than three electrical wires, and more than one wire is applied for the data line. The data line could also comprise an optical medium such as an optical wave guide, e.g. an optical fiber.

In an embodiment according to the invention, the elongated member comprises a sound tube for transferring an acoustic signal from said base part to said ear plug part. Such a sound tube facilitates the application of two different receiver units, where at least one receiver could be arranged in the base part of the hearing aid. This could be the low frequency receiver, for which the loss in the sound tube is smaller than for higher frequencies. Then the high frequency receiver unit could be arranged in the ear plug part.

In an embodiment according to the invention where the ear plug part comprises at least one receiver unit, the electric signal for said receiver unit is transmitted as digital communication through the serial databus arranged in the elongated member. Thereby, acoustic loss in a sound tube is avoided.

In an embodiment according to the invention the receiver unit in the ear plug part is for transmitting the high frequency part of the acoustic signal, and the low frequency part of the acoustic signal is transmitted through said sound tube from a low frequency receiver unit arranged in the base part.

In an embodiment according to the invention the ear plug part comprises an electronic chip connected with the ear canal microphone, said chip further being connected with electrical wires of the elongated member. This chip preferably comprises circuits for handling the digital communication through the dataline. Preferably, the electronic chip comprises a voltage regulator for the power supply of the ear canal microphone. Preferably, the electronic chip comprises an analog to digital converter for converting an analog signal from the ear canal microphone into a digital signal. The electronic chip may also comprise a sigma-delta converter for converting the microphone signal.

In an embodiment according to the invention the base part of the hearing aid is arranged to apply a first clock frequency for the signal processing means, and the ear plug part is arranged to apply a second clock frequency for the electronic module. Preferably, these two clock frequencies are synchronized. This may be done by arranging a clock frequency generator in either the base part or in the ear plug part of the hearing aid, and regenerate a clock frequency in the part of the hearing aid without clock frequency generator.

In a further embodiment the regenerated clock frequency is being synchronized with the clock frequency of said clock frequency generator. Often the clock frequency generator is arranged in said base part of the hearing aid, where there is usually more space available.

In a further embodiment the synchronization between the first and the second clock frequency is performed by a phase-locked loop.

In an embodiment according to the invention the ear plug part is connected with a transducer for measuring a physical or physiological parameter. Such a transducer could be adapted for measuring temperature, blood pressure, movement e.g. acceleration, orientation, i.e. is the person lying down, electrical signals of the body, e.g. EEG or ECG. Preferably such transducer is connected to the electronic module of the ear plug part and is prepared for transferring data to the signal processing means in said base part through the serial databus.

The invention, in a second aspect, provides a method for communicating between two parts of a hearing aid comprising power supply means and at least one microphone for transforming an acoustic signal in the surroundings of a hearing aid user into an electric signal, said two parts being connected through at least two wires, said method comprising arranging a base part outside the ear canal of a hearing aid user, said base part comprising signal processing means, arranging an ear plug part in the ear canal of a hearing aid user, said ear plug part comprising acoustic transmitting means for transmitting sound into the ear canal, an ear canal microphone for transforming an acoustic signal in the ear canal into an electric signal, and an electronic module connected to said ear canal microphone, connecting said ear plug part with said base part by an elongated member, said elongated member comprising electrical wires adapted for providing power supply from the base part to the ear plug part, or, from the ear plug part to the base part, and transferring the signal from the ear canal microphone to the signal processing means in said base part through a one line bidirectional serial databus connected through a data line arranged in said elongated member.

The invention, in a third aspect, provides a hearing aid comprising a power supply means; at least one microphone for transforming an acoustic signal in the surroundings of a hearing aid user into an electric signal; a base part to be arranged outside the ear canal of a hearing aid user, said base part comprising signal processing means; an ear plug part to be arranged in the ear canal of a hearing aid user, said ear plug part comprising acoustic transmitting means for transmitting sound into the ear canal, an ear canal microphone for transforming an acoustic signal in the ear canal into an electric signal, and an electronic module connected to said ear canal microphone; and an elongated member connecting said ear plug part with said base part, said elongated member comprising electrical wires adapted for providing power supply from the base part to the ear plug part, or, from the ear plug part to the base part, wherein the signal from the ear canal microphone is transferred to the signal processing means in said base part by a serial databus connected through an optical fiber.

BRIEF DESCRIPTION OF THE DRAWINGS

Embodiments of the invention will now be explained in further detail with reference to the figures.

DETAILED DESCRIPTION OF THE INVENTION

Figure 1:
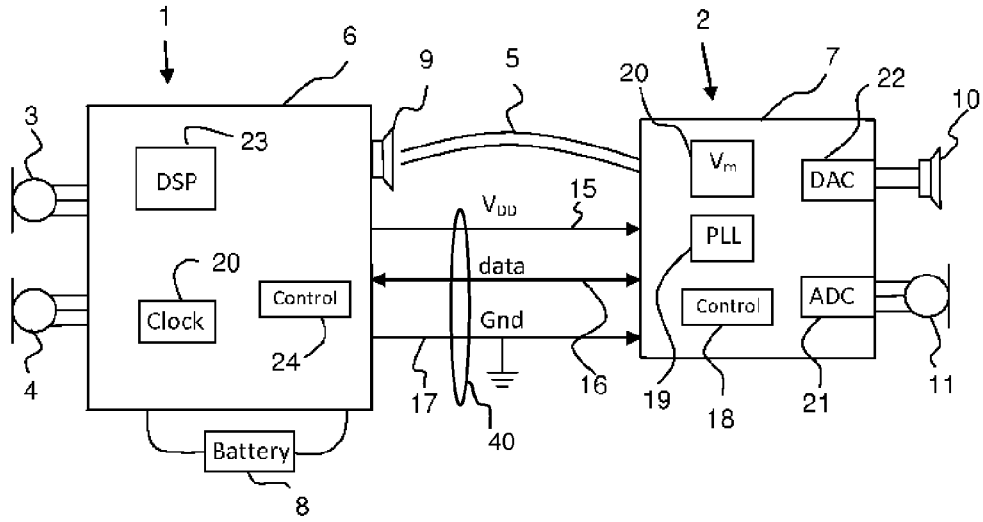
FIG. 1 illustrates an embodiment where a hearing aid is provided with a sound tube between the base part and the ear plug part.

FIG. 1 shows the principles of a hearing aid according to an embodiment. The base part 1, often arranged behind the ear, comprises two microphones 3, 4, an electronic module 6, a receiver 9 and a battery 8. The electronic module 6 comprises signal processing means 23, a clock generator 20 and a controller 24 for controlling the communication on the data line 16. The ear plug part 2 comprises an electronic module or electronic chip 7 and a microphone 11. The ear plug part 2 also comprises a receiver 10. This receiver 10 is intended for the relatively high frequencies, e.g. 3 kHz-15 kHz, while the lower frequencies, e.g. 20 Hz-3 kHz, are generated in the receiver 9 arranged in the base part. The sound from this low frequency receiver 9 is transmitted to the ear plug part 2 through the sound tube 5. The loss when transmitting low frequency sound through the sound tube 5 is lower than the loss when transmitting higher frequencies through the sound tube. Since there may not always be sufficient space for two receiver units in the ear plug part it may be advantageous to have the low frequency unit in the base portion. This will, however, make the application of a sound tube between the base part and the ear plug part necessary.

The electronic module 7 of the ear plug part 2 comprises a digital to analog converter 22 for driving the high frequency receiver 10, and an analog to digital converter 21 for digitizing the signal from the microphone 11 near the tympanic membrane. Both converters may be in the form of sigma delta converters, known from U.S. Pat. No. 5,878,146.

The sound tube will also be necessary in the situation where there is no receiver unit in the ear plug part. In that situation one or two receiver units will be arranged in the base part. Such an embodiment may be preferred for high power hearing aids where large receiver units are necessary in order to obtain sufficient sound pressure.

Figure 2:
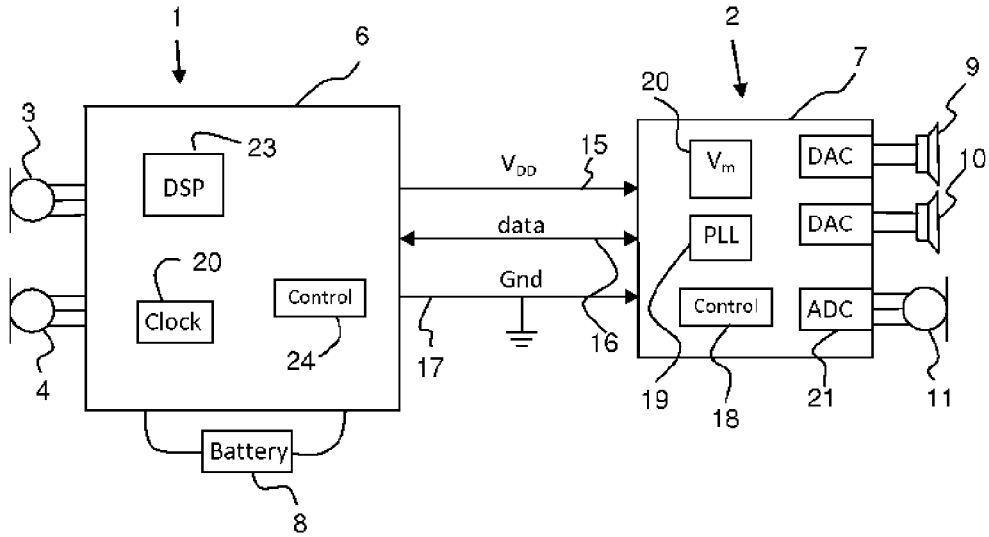
FIG. 2 illustrates an embodiment of the hearing aid, similar to FIG. 1, but without a sound tube.

FIG. 2 shows an embodiment of a hearing aid where there is no sound tube because the two receiver units 9, 10 are arranged in the ear plug part 2. The two receiver units 9, 10 shown could as well be one combined unit.

Three wires or lines are connecting the base part with the ear plug part in the embodiment illustrated in FIGS. 1 and 2. Two electrical wires 15, 17, are for the power supply and one wire or line 16 is for the digital communication line, i.e. the serial databus. In principle the digital communication could also have been performed via a power supply wire, thereby reducing the necessary number of wires to two. This could cause some noise problems, and would imply further signal processing of the communication line. Another option is to have four, or more, wires connecting the base part with the ear plug part, thereby enabling one wire for communication from the base part to the ear plug part and one wire for communication from the ear plug part to the base part.

The data line or serial databus 16 may have the form of one or more electrical wires or it could be an optical wave guide such as one or more optical fibers. In the case of optical fibers an LED or semi conductor Laser and an appropriate detector should be arranged in both hearing aid parts. US-A1-2008/0107292 discloses a hearing aid where an optical wave guide is connecting an optical microphone in the ear canal with a behind-the-ear base part.

The data line signal may also be sent as a balanced signal on a pair of wires. This will also reduce the risk of noise influencing the data line communication. A balanced pair of wires could be twisted in order to further reduce noise influence.

In order to obtain both a thin combined wire and a stable communication between the base part and the ear plug part, three wires are often preferred for the connection. This means that one wire is to be applied for the digital communication in both directions. Different types of protocols may be applied for controlling this communication.

Usually the battery is arranged in the base part and a voltage regulator is applied for supplying a stable voltage $V_{DD}$ for the electronic modules. A voltage transferred through wires in the elongated member may be affected or disturbed by e.g. an electrical data line or external devices. Therefore, it is often preferred to transfer the battery voltage directly and to provide a local voltage regulator 20 in the ear plug part.

Figure 3:
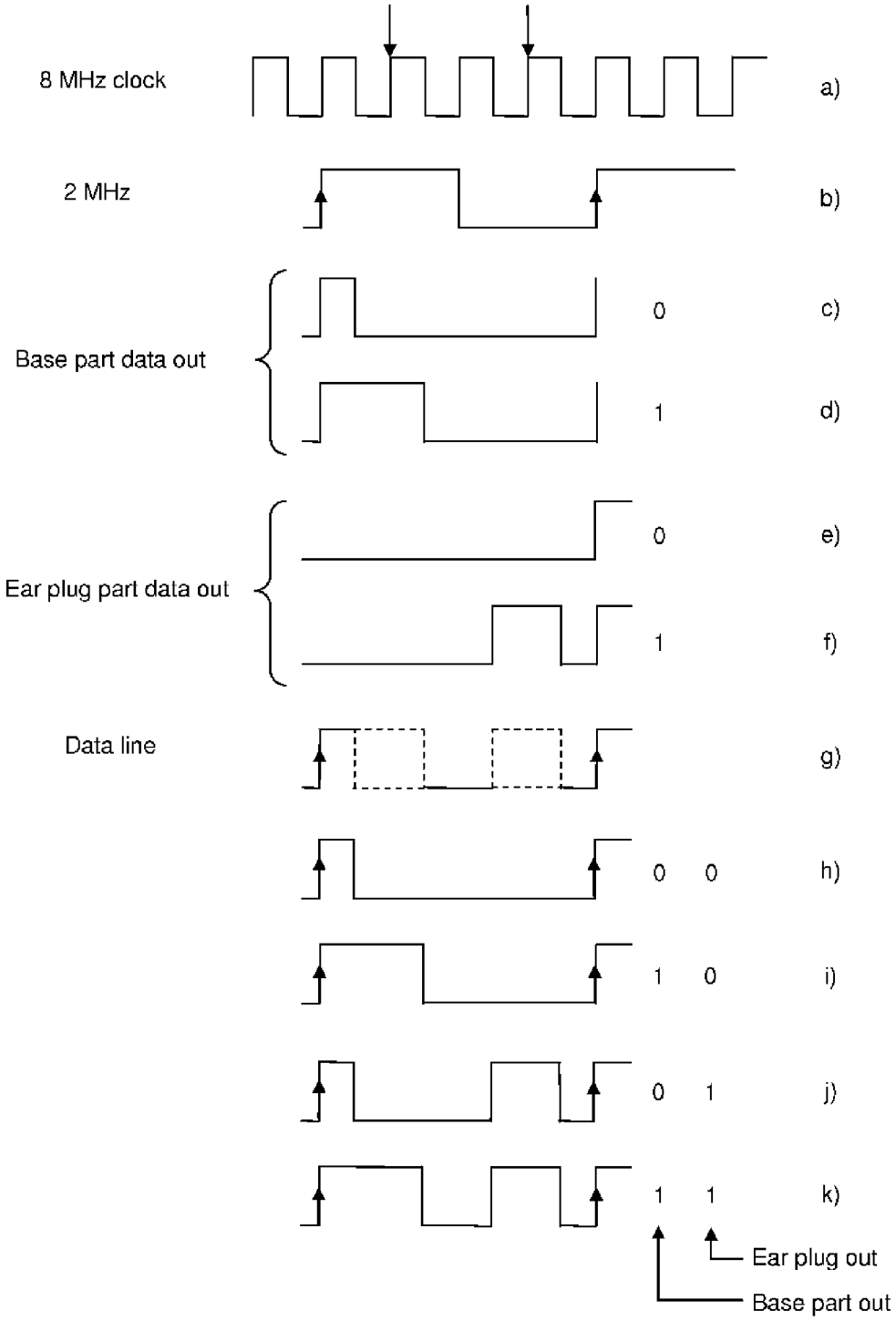
FIG. 3 illustrates the bidirectional digital communication through a single wire databus, panes (a) through (k) signifying respective signals.
Figure 4:
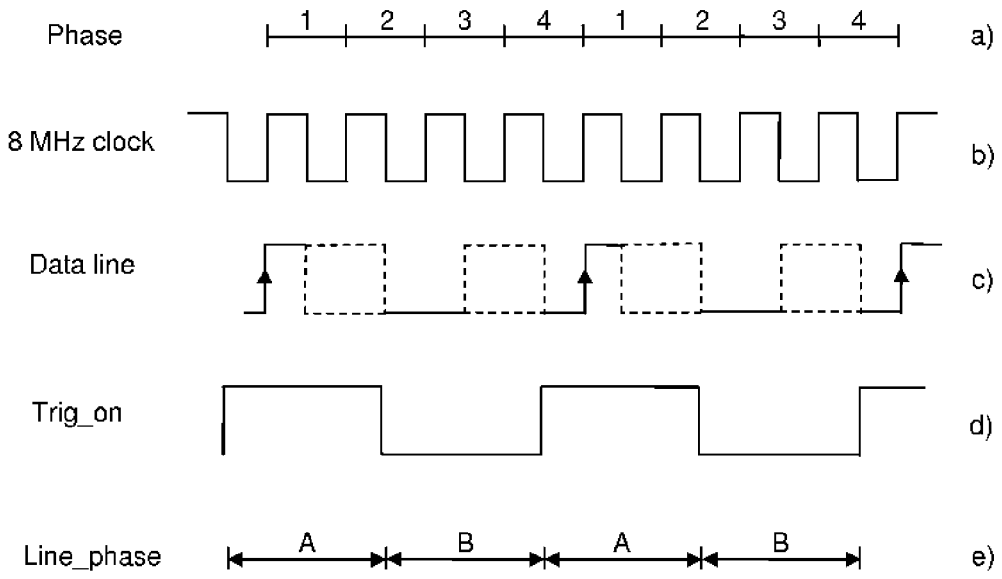
FIG. 4 illustrates different states for controlling the bidirectional digital communication, panes (a) through (e) signifying respective signals.

FIGS. 3 and 4 show one example on how the communication through a one line bidirectional serial databus 16 could be handled. The example may apply for both an electrical wire and an optical fiber as data line. In FIG. 3 pane a shows an 8 MHz clock frequency generated in the base part 1. A corresponding 8 MHz clock frequency is generated in the ear plug part 2 by application of a phase-locked loop (PLL) circuit 19 (see FIG. 5). The PLL 19 regenerates the 8 MHz clock frequency by application of the data line signal. The PLL continuously adjusts the synchronization between the two 8 MHz clock frequencies, by application of rising edges in the data line signal. When the clock generator 20 is arranged in the base part, as in this example, the PLL is arranged in the ear plug part. This synchronization is important for the proper functioning of the one or two sigma-delta converters driving the one or two receivers 9, 10. If the two clock frequencies get slightly out of phase, phase noise will be introduced in the at least one receiver. Clock jitter caused by an unstable clock frequency will reduce the quality and reliability of the data communication. This can be avoided when a crystal is applied for clock frequency generator, and this clock frequency is transferred to the other part of the hearing aid, e.g. by the method described above. Transferring the crystal based clock frequency results in a reliable communication.

Figure 5:
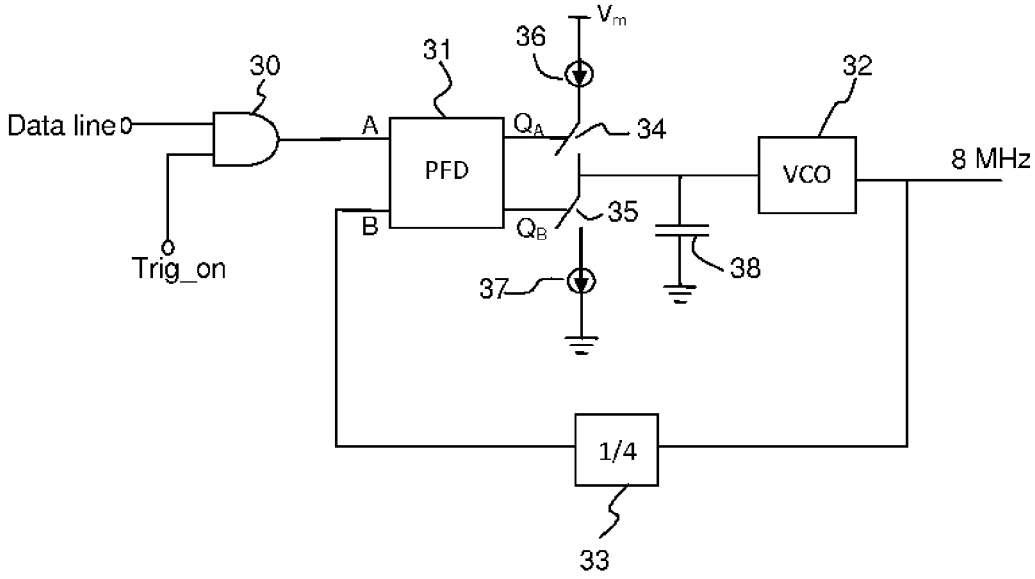
FIG. 5 illustrates a phase locked loop circuit applied in an embodiment of the invention.

A result of the application of the PLL circuit shown in FIG. 5 is that a 2 MHz clock frequency is also generated (see FIG. 3 pane b). This 2 MHz clock frequency is generated by a divider 33 in the feedback loop of the PLL, and is applied for synchronizing with the frequency of the rising edges in the data line signal. Often a 2 MHz clock frequency is also necessary for the receiver.

FIG. 3, in panes c and d, shows an example on sending one bit from the base part to the ear plug part, where a "0" is sent in FIG. 3*c* and a "1" is sent in FIG. 3*d*. In both FIG. 3*c* and in FIG. 3*d* a "0" is sent out of the ear plug part.

FIG. 3 in panes e and f, shows an example on sending one bit from the ear plug part to the base part, where a "0" is sent in FIG. 3*e* and a "1" is sent in FIG. 3*f*. In both FIG. 3*e* and in FIG. 3*f* a "0" is sent out of the base part.

FIG. 3, in pane g, shows the resulting signal on the bidirectional data communication line, where the dashed lines indicate that the signal can follow one of the two possible routes, resulting in either a "0" or a "1" being sent. This resulting signal on the data line is a summation of signals from FIG. 3*c* or 3*d*, and FIG. 3*e* or 3*f*. In the example there will be a rising edge, indicated by arrows in FIG. 3*g*, in the data line signal for every fourth rising edge in the 8 MHz clock frequency. This is equivalent to a rising edge in the data line signal for every rising edge in the 2 MHz frequency, also indicated with arrows in FIG. 3*b*. This means that the signal on the data line must go low before this rising edge, which is also the case in the data line signal shown in FIG. 3*g*. A change in the data line signal level only occurs on rising or falling edges of the 8 MHz clock frequency.

The mentioned rising edges in the data line signal, indicated with arrows in FIG. 3*g*, are applied for the PLL to synchronize the clock signals between the base part and the ear plug part.

FIG. 4, in pane a, further illustrates the states of a phase counter. A phase counter is present in both the base part and in the ear plug part. The phase counter is part of a control means 18 of the ear plug part. These two phase counters are synchronized by the PLL via rising edges of the data line. The phase counter starts on 1 on a rising edge of the data line signal and increments by one for each rising edge on the 8 MHz clock until 4. After 4 the phase counter starts from 1 again. The phase counters can also be incremented by half by identifying the falling edges on the 8 MHz clock.

The phase counters are applied for identifying which part, the base part or the ear plug part, is sending data out. For this purpose a line_phase is defined as shown in FIG. 4 pane e. In the periods where line_phase equals "A", the base part is sending, and in the periods where line_phase equals "B", the ear plug part is sending. In the example the line_phase is set to "B", when the phase counter is between 1.5 and 3.5. In the rest of the cycle the line_phase is set to "A".

FIG. 4 pane b repeats the 8 MHz clock frequency, and FIG. 4 pane c repeats the data line signal, both for ease of comparison in FIG. 4.

In order to discriminate between the rising edges of the data line signal intended for synchronization, illustrated with arrows in FIG. 3*g*, and the rising edges, which will occur every time a "1" is sent from the ear plug part to the base part, the control unit 18 of the electronic module 7 of the ear plug part 2 is arranged for generating a signal to be applied for this discrimination. This signal is called trig_on and is illustrated in FIG. 4 pane d.

The trig_on signal is set to "1" (or high), when the line_phase equals "A". The trig_on signal is set to "0" (or low), when the line_phase equals "B".

FIG. 5 shows an example of the phase locked loop (PLL) circuit 19 applied for synchronizing the 8 MHz clock frequency by application of rising edges marked with arrows in FIGS. 3*g* and 4*c*. The data line signal goes to an AND operator 30 together with the trig_on signal. The output of the AND operator 30 will thus only go high for the rising edges of the data line signal, marked with an arrow, and not for the rising edge when the ear plug part is sending a "1", where the trig_on signal is low (see FIGS. 4*c* and 4*d*).

The signal from the AND operator 30 is the reference input (A) to the phase frequency detector (PFD) 31. The other input (B) to the PFD 31 is the feedback from the voltage controlled oscillator (VCO) 32 through a divider 33. The two outputs $Q_A$ and $Q_B$ of the PFD 31 control a first switch 34 and a second switch 35 through a train of pulses. A first constant current generator 36 and a second constant current generator 37 will either charge or discharge a capacitor 38, thereby determining the input voltage to the VCO 32. The two current generators 36, 37 generate the same current. A pulse on $Q_A$ will close the first switch 34 connected with $Q_A$, whereby the first constant current generator 36 will be charging the capacitor 38. A pulse on $Q_B$ will close the second switch 35 connected with $Q_B$, whereby the second constant current generator 37 will be discharging the capacitor 38.

When the two signals on input A and B of the PFD 31 are synchronized or locked, the length of the pulses $Q_A$ and $Q_B$ are the same and the voltage on the VCO 32 input remains unchanged. If the two signals on input A and B of the PFD 31 are out of synchronization, the pulses on one of the outputs $Q_A$ and $Q_B$ of the PFD 31 become longer than the pulses on the other output, thereby either charging or discharging the capacitor 38. This will adjust the input voltage on the VCO 32 to a level where the output frequency of the VCO is synchronized with the data line signal.

When starting up the bidirectional digital communication line, e.g. when turning on the hearing aid, or when resetting the communication line, the controller 18 should wait for the PLL to lock, i.e. for the two 8 MHz frequencies to become synchronized. This is the case when the length of the pulses $Q_A$ and $Q_B$ are the same or approximately the same. When this happens, the line_phase is set to A. The ear plug part will now be waiting for a rising edge on the data line. When the controller 18 detects a rising edge on the data line, the phase counter is set to 1. From this point in time the phase counter and the line_phase will continue as shown in FIGS. 4*a* and 4*e*, and as described above. In order for this start up procedure to function properly, no data should be transmitted from the ear plug part. This means that the data line signal initially has to look like the signal in FIG. 3, panes h or i, i.e. sending "0" only from the ear plug part to the base part.

Resetting the communication line, and subsequent application of the above start-up procedure, can be initialized if the connection at one or more lines or wires is temporary lost. Such a temporarily loss of connection can be detected by the control circuit 18 of the ear plug electronic module 7. This could be done by checking the voltage over the capacitor 38 in the PLL 19 (see FIG. 5). The rising edges of the dataline signal stops, this voltage will fall towards zero, and when the control circuit 18 detects this, the ear plug part should stop sending data on the dataline and at the same time the above start-up procedure should be initialized. The control circuit 18 may also be set up for detecting any temporary loss of connection on the power supply wires.

A specific code may be applied for confirming that the clock frequencies are properly synchronized. This code, or a different code, could also be sent with specific time intervals to confirm that the communication is functioning as scheduled. If this code stops, or the time intervals are not properly followed, a reset procedure could also be initialized.

In the above example of the data communication one cycle of the clock frequency is applied for sending one bit from the base part to the ear plug part and one bit from the ear plug part to the base part. The data communication could be arranged in many other ways. The base part could be sending in one clock cycle and the ear plug part could be sending in the next clock cycle, followed by the base part etc. Other options within the embodiments of the invention could be to send e.g. 8 or 16 bits from the base part followed by the same number of bits sent from the ear plug part, again followed by the base part and so on.

Further to sound signals, of which there will often be two, it is preferred also to include other types of information in the data communication. This could be control bits identifying the type of information being sent and identifying the transducer generating the signal. Transducer types other than microphones and receivers could be applied. This could be a thermometer or electrodes for measuring bioelectrical signals from the person wearing the hearing aid.

Also configuration data could be included in the data communication. This could be data identifying the type of ear plug part applied. This would be relevant in the case where different ear plug parts may be applied together with the same base part. A type number identifying the ear plug part could be stored in the control circuit 18 and communicated to the base part, e.g. upon request. Further to this, also status information can be sent via the data line. This could be the status on the clock synchronization.

Figure 6:
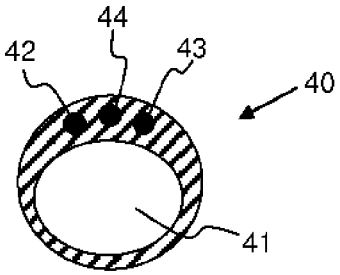
FIG. 6 illustrates a cross sectional view of an elongated member with a sound tube and three wires.

FIG. 6 shows a cross sectional view of an elongated member 40, where a sound tube 41 will take up a major part of the space. The material of which the elongated member 40 is formed is often a polyamide material. The polyamide is often modified by addition of other materials, such as a biocompatible softener.

The wires 42, 43 for power supply lines 15, 17 are preferably fully incorporated in the material forming the elongated member 40 and the sound tube 41. Also the one or more lines 44 forming the data line 16 are preferably fully incorporated in this material. As mentioned the line 44 forming the data line 16 may be one or more electrical wires or it may be one or more optical fibers. In order to keep the outer diameter of the elongated member 40 as small as possible, the number of lines for the data line should preferably be as low as possible, independently of whether electrical wires or optical fibers are applied.

A small outer diameter of the elongated member makes the elongated member easier to fit to the ears of most hearing aid users, and a small outer diameter is also preferred by many hearing aid users for cosmetic reasons. Embodiments without sound tube can be made with a considerably smaller outer diameter, or there will be space for more lines for the data line, e.g. two electrical wires or two optical fibers, one line for communication in each direction. However, the plugs connecting the elongated member with the ear plug part and with the base part, respectively, will also take up more space with more wires needing termination.

When the data line is arranged as one electrical wire, this may be configured as a pair of twisted wires for a balanced signal. This will reduce the sensibility of the data line to electrical noise.

One way of keeping the number of lines for the data line low, preferably at one, is to increase the clock frequency of the two parts of the hearing aid, which will increase the amount of information which can be submitted per line correspondingly.

A digitized sound signal often needs a bandwidth of 32 kHz at a resolution of 16 bit in order to provide a sufficiently high sound quality. This means that a signal of 512 kHz needs to be transferred in each direction when a receiver and a microphone are arranged in the ear plug part. So, with a clock frequency of 8 MHz there will be sufficient capacity for at least two sound signals and for signals of other transducers and for control bits, configuration data and status information.

When adding further transducers to e.g. the ear plug part, where data needs to be transferred through the data line to the base part, further bandwidth of the data line is necessary. Depending on the type of these transducers, the amount of data to transfer may vary significantly. If the transducer is a thermometer or an accelerometer for detection of movements, the necessary amount of data for transfer may be relatively limited, whereas when the transducer is adapted for picking up one or several EEG signals, more data need to be transferred, but still considerably less than is the case for a sound signal.

When a number of transducers are comprised in or connected with the ear plug part, the data from these may be collected by the electronic module 7 of the ear plug part and packaged into a format suitable for sending via the data line 16 together with e.g. the digitized sound signal from a microphone 11.

We claim:

1. A hearing aid comprising a power supply means;

at least one microphone for transforming an acoustic signal in the surroundings of a hearing aid user into an electric signal;

a base part to be arranged outside the ear canal of a hearing aid user, said base part comprising signal processing means;

an ear plug part to be arranged in the ear canal of a hearing aid user, said ear plug part comprising acoustic transmitting means for transmitting sound into the ear canal, an ear canal microphone for transforming an acoustic signal in the ear canal into an electric signal, and an electronic module connected to said ear canal microphone; and an elongated member connecting said ear plug part with said base part, said elongated member comprising electrical wires adapted for providing power supply from the base part to the ear plug part, or, from the ear plug part to the base part, wherein the signal from the ear canal microphone is transferred to the signal processing means in said base part by a one line bidirectional serial databus connected through a data line arranged in said elongated member.

2. The hearing aid according to claim 1, wherein said base part is adapted to be arranged behind the ear.

3. The hearing aid according to claim 1, wherein said elongated member comprises three electrical wires.

4. The hearing aid according to claim 1, wherein said data line comprises an optical wave guide.

5. The hearing aid according to claim 1, wherein said elongated member comprises a sound tube for transferring an acoustic signal from said base part to said ear plug part.

6. The hearing aid according to claim 1, wherein said ear plug part comprises at least one receiver unit, where the electric signal for said receiver unit is transmitted as digital communication through said serial databus.

7. The hearing aid according to claim 6, wherein said receiver unit is adapted for transmitting the high frequency part of the acoustic signal, and a low-frequency receiver unit is arranged in the base part and adapted for transmitting the low-frequency part of the acoustic signal through a sound tube.

8. The hearing aid according to claim 1, wherein said ear plug part comprises an electronic chip connected with the ear canal microphone, said chip being connected with electrical wires of the elongated member.

9. The hearing aid according to claim 8, wherein said electronic chip comprises a voltage regulator for the power supply of the ear canal microphone.

10. The hearing aid according to claim 8, wherein said electronic chip comprises an analogue to digital converter for converting an analogue signal from the ear canal microphone into a digital signal.

11. The hearing aid according to claim 10, wherein said analogue to digital converter is a sigma-delta converter.

12. The hearing aid according to claim 1, wherein a clock frequency generator is arranged in either the base part or the ear plug part of the hearing aid, and wherein a clock frequency is regenerated in the part of the hearing aid without clock frequency generator.

13. The hearing aid according to claim 12, wherein said regenerated clock frequency is synchronized with the clock frequency of said clock frequency generator.

14. The hearing aid according to claim 12, wherein said clock frequency generator is arranged in said base part of the hearing aid.

15. The hearing aid according to claim 13, wherein said synchronization is performed by a phase-locked loop.

16. The hearing aid according to claim 1, wherein said ear plug part is connected with a transducer for measuring a physical or physiological parameter.

17. The hearing aid according to claim 16, wherein said transducer is connected to said electronic module of the ear plug part and is adapted for transferring data to the signal processing means in said base part through the serial databus.

18. The hearing aid according to claim 1, wherein said one line bidirectional serial databus is applied for data transfer between the base part and the ear plug part and for synchronization of the clock frequency in the two parts.

19. The hearing aid according to claim 1, wherein said ear canal microphone is responsive to an acoustic signal from a location in said ear canal between said ear plug part and a tympanic membrane.

20. The hearing aid according to claim 1, wherein said data line comprises an optical fiber.

21. A method for communicating between two parts of a hearing aid comprising power supply means and at least one microphone for transforming an acoustic signal in the surroundings of a hearing aid user into an electric signal, said two parts being connected through at least two wires, said method comprising arranging a base part outside the ear canal of a hearing aid user, said base part comprising signal processing means, arranging an ear plug part in the ear canal of a hearing aid user, said ear plug part comprising acoustic transmitting means for transmitting sound into the ear canal, an ear canal microphone for transforming an acoustic signal in the ear canal into an electric signal, and an electronic module connected to said ear canal microphone, connecting said ear plug part with said base part by an elongated member, said elongated member comprising electrical wires adapted for providing power supply from the base part to the ear plug part, or, from the ear plug part to the base part, and transferring the signal from the ear canal microphone to the signal processing means in said base part through a one line bidirectional serial databus connected through a data line arranged in said elongated member.

22. The method according to claim 21, wherein said ear canal microphone is responsive to an acoustic signal from a location in said ear canal between said ear plug part and a tympanic membrane.

23. The method according to claim 21, wherein said data line comprises an optical fiber.

* * * * *